US009666938B2

(12) United States Patent
Oon et al.

(10) Patent No.: US 9,666,938 B2
(45) Date of Patent: May 30, 2017

(54) ANTENNA STRUCTURE FOR MULTIBAND APPLICATIONS

(71) Applicant: MOTOROLA SOLUTIONS, INC, Schaumburg, IL (US)

(72) Inventors: Chin Keong Alexander Oon, Penang (MY); Poh Imm Goh, Pulau Pinang (MY); Teik Yang Goh, Pulau Pinang (MY); Seow Teng Wong, Penang (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 14/745,161

(22) Filed: Jun. 19, 2015

(65) Prior Publication Data

US 2016/0372824 A1 Dec. 22, 2016

(51) Int. Cl.

| | |
|---|---|
| ***H01Q 1/08*** | (2006.01) |
| ***H01Q 1/36*** | (2006.01) |
| ***H01Q 5/357*** | (2015.01) |
| ***H01Q 5/40*** | (2015.01) |
| ***H01Q 5/307*** | (2015.01) |
| *H01Q 1/24* | (2006.01) |
| *H01Q 1/12* | (2006.01) |
| *H01Q 11/08* | (2006.01) |
| *H01Q 3/24* | (2006.01) |
| *H01Q 21/28* | (2006.01) |
| *H01Q 7/08* | (2006.01) |

(52) U.S. Cl.

CPC ..... *H01Q 1/362* (2013.01); *H01Q 1/1242* (2013.01); *H01Q 5/307* (2015.01); *H01Q 5/357* (2015.01); *H01Q 5/40* (2015.01); *H01Q 11/083* (2013.01); *H01Q 1/125* (2013.01); *H01Q 1/243* (2013.01); *H01Q 3/24* (2013.01); *H01Q 7/08* (2013.01); *H01Q 11/08* (2013.01); *H01Q 21/28* (2013.01)

(58) Field of Classification Search

CPC ..... H01Q 1/125; H01Q 11/08; H01Q 21/28; H01Q 3/24; H01Q 1/243; H01Q 7/08

USPC ..... 343/880, 725, 724, 895, 787, 702

See application file for complete search history.

(56) References Cited

U.S. PATENT DOCUMENTS

| | | | | |
|---|---|---|---|---|
| 4,097,867 | A | 6/1978 | Eroncig | |
| 5,563,615 | A | 10/1996 | Tay et al. | |
| 5,668,559 | A | 9/1997 | Baro | |
| 7,969,379 | B2 | 6/2011 | Knudsen et al. | |
| 8,884,838 | B2 | 11/2014 | Contreras et al. | |
| 2009/0267847 | A1 | 10/2009 | Sato et al. | |
| 2010/0188303 | A1* | 7/2010 | Koh | H01Q 5/00 343/725 |
| 2015/0116181 | A1 | 4/2015 | Williams et al. | |

FOREIGN PATENT DOCUMENTS

| | | | |
|---|---|---|---|
| EP | 1926175 | A1 | 5/2008 |
| WO | 2006097919 | A2 | 9/2006 |

OTHER PUBLICATIONS

The International Search Report and the Written Opinion, SN: PCT/US2016/037736, filed: Jun. 16, 2016, mailed: Sep. 28, 2016, all pages.

* cited by examiner

*Primary Examiner* — Joseph Lauture
(74) *Attorney, Agent, or Firm* — Barbara R. Doutre

(57) ABSTRACT

An antenna (100) having an antenna structure is provided. The antenna structure is formed of a first section (102) and a second section (104). The first section is formed of a rolled conductive strip forming a helical coil having non-overlapping successive turns, and the second section (104) is formed of a wire spring coil having non-overlapping successive turns. The antenna (100) provides multi-band capability.

20 Claims, 6 Drawing Sheets

ANTENNA STRUCTURE FOR MULTIBAND APPLICATIONS

FIELD OF THE DISCLOSURE

The present disclosure relates generally to antennas, and more particularly to external antennas for communications products, and more particularly to antenna structures for multi-band applications.

BACKGROUND

Communications devices often, operate utilizing an external antenna. Communication devices, such as portable two-way radios, which operate over different frequency bands are considered desirable, particularly in the public-safety arena where such devices are used by different agencies such as police departments, fire departments, emergency medical responders, and military, to name a few.

Depending on space constraints and the desired frequency bands of operation, the antenna structures capable of achieving multi-band operation can be structurally complex. For example, matching components mounted to printed circuit boards can contribute to the stiffness and inflexibility of an antenna. Additionally, rigid and lengthy antenna structures may be prone to breakage under stress and impractical to wear on the body. Gain, bandwidth, size, cost and ease of manufacturability are all factors to be considered during the design of an antenna.

Accordingly, it would be desirable to have a multi-band antenna having a relatively small and flexible form factor.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
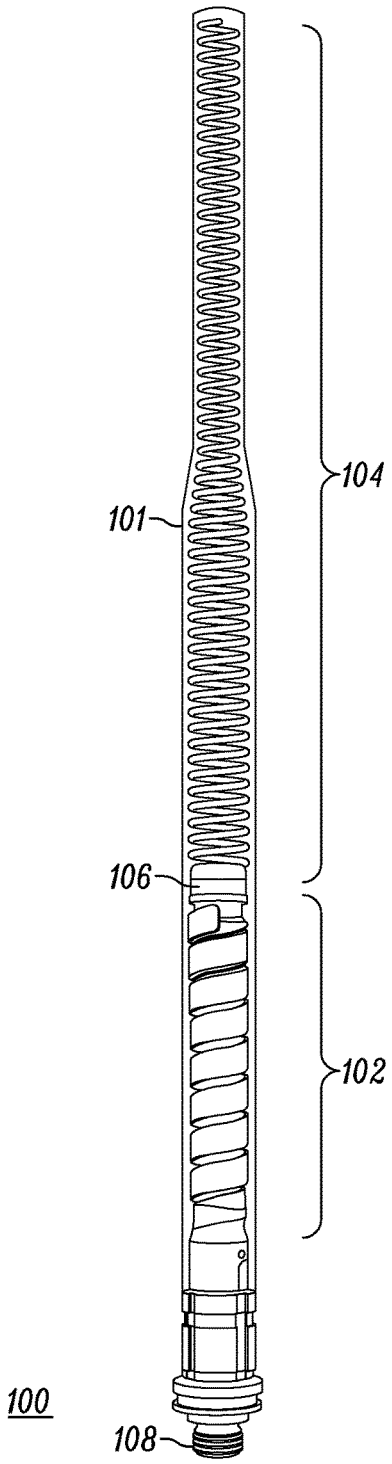
FIG. 1 is an antenna formed in accordance with some embodiments.

Those skilled in the field of the present disclosure will appreciate that elements to the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Well known elements, structure, or processes that would be necessary to practice the invention, and that would be well known to those of skill in the art, are not necessarily shown and should be assumed to be present unless otherwise indicated.

DETAILED DESCRIPTION

Briefly, there is provided herein a single combined antenna structure that functions in at least two bands. The antenna structure incorporates a non-overlapping radiator structure allowing for a compact and flexible form factor. The antenna structure is particularly applicable to hand held wireless communication products, such as portable two-way radio subscriber units, where the available volume within the housing of the device is very limited. The single combined structure operates over a very high frequency (VHF) band (about 136-174 MHz) and an ultra high frequency (UHF) band (about 380-527 MHz). The structure may also be adapted to other frequency bands, for example 7/800 MHz frequency hand (764-869 MHz). A radio incorporating the new antenna structure is particularly advantageous for public-safety providers (e.g., police, fire department, emergency medical responders, and military) by providing increased communication options. The antenna formed in accordance with the various embodiments does not require matching components thereby negating the need for a printed circuit board (pcb) making for a highly flexible structure that is readily manufacturable. The components are not drawn to scale with respect to each other in order to facilitate viewing.

FIG. 1 is an antenna 100 formed in accordance with some embodiments. The antenna 100 comprises a first section 102, a mid-section interconnect 106, and a second section 104, all housed within a sleeve 101. The antenna 100 may further comprise an attachment means 108 coupled to the first section 102 for interfacing to a communication device, such as a portable radio device or other electronic device. Alternatively, the antenna 100 may be directly coupled to the communication device without connector 108. Antenna 100 provides multiband frequency operation in a flexible antenna structure without the need for matching components. Although matching components are not required at the antenna side, matching components may be used, if desired for certain applications, at the communication device side.

Figure 2:
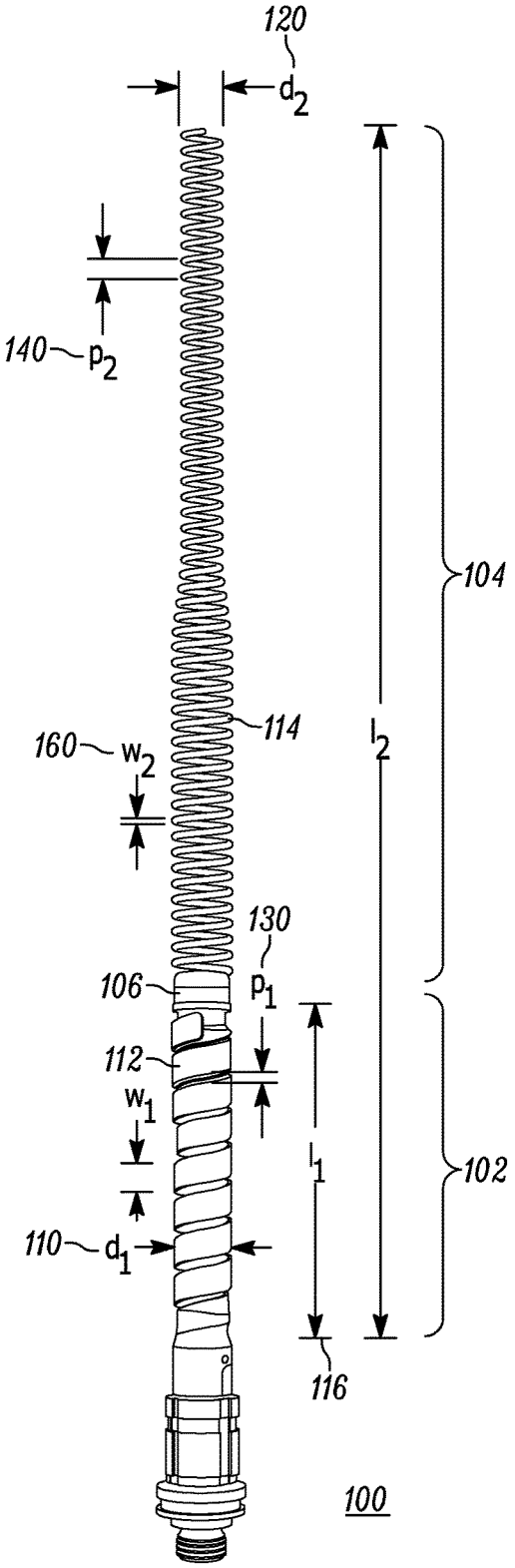
FIG. 2 shows the antenna structure of FIG. 1 in accordance with some embodiments.

FIG. 2 shows the antenna 100 with the sleeve 101 removed, thus exposing the antenna structure formed in accordance with some embodiments. Antenna 100 comprises first section 102 and second section 104. The first section 102 comprises a rolled conductive strip 112 forming a helical coil having non-overlapping successive turns. The first section 102 may be formed of such material as copper or other appropriate antenna material. In accordance with some embodiments, the first section 102 provides support for the second section 104. The second section 104 is electrically coupled to the first section 102, such as via a connector 106. The electrical coupling may be accomplished via the connector 106 or other interconnect means. The interconnect means provides electrical coupling between the two sections 102, 104 while provide appropriate ruggedness that avoids snapping during flexing of the antenna 100.

The second section 104 comprises a single wire spring coil 114 having non-overlapping successive turns. The second section 104 may be formed of such material as copper or other appropriate antenna material. In general, the material for the first and second sections 102, 104 may be formed of similar materials. In general, the materials selected for the two sections 102, 104 should be highly conductive on the outer layer and have relatively high tensile strength as a whole, thereby advantageously providing recovery of shape after bending/flexing. The bottom, first section 102 is preferably formed in a more—flat ribbon-like shape, while the top, second section 104 is formed of a more rounded-coil shape.

In accordance with some embodiments, a first diameter "d1" 110 and first length "l1" 116 of the first section 102 are optimized for resonance at a higher UHF frequency band, and the second diameter "d2" 120 and second length "l2" 126 of the second section 104, in conjunction with the first section 102, are optimized for resonance at a lower VHF frequency band.

In accordance with some embodiments, the resonance frequency for the UHF and VHF bands may be tuned independently. This independent tuning may be accomplished by varying length one or more parameters such as length (l1, l2) 116, 126, the pitch (p1, p2) 130, 140 and/or width (w1, w2) 150, 160 to control UHF and VHF band frequencies.

An antenna structure was built in which the antenna provides the following characteristics: electrical length for first section ($L_1$) is ~¼λ at UHF; and total electrical length $L_{total}$ for first section and second section is ~¼λ at VHF. The overall mechanical length measured approximately 197 mm.

In some embodiments, the antenna 100 may further comprise a flexible rod or core about which the first and second sections may be wrapped. For example, the rod or core may be formed of a flexible, non-conductive material, such as silicone, or other elastomeric material with good RF properties, such as low RF losses, to maintain the flexibility for the antenna 100. The flexible rod may have a variable diameter to further facilitate varying the diameter of the antenna sections if desired.

In some embodiments, the first section 102 may comprise an Interior layer of non-conductive film, such as a polyimide film. If desired, to avoid inadvertent shorts between the non-overlapping turns during flexing of the antenna. However, appropriate selection of spacing between non-overlapping turns actually minimizes the need for any such films. The rolled conductive strip 112 being selected with appropriate thickness for flexibility and being wrapped in non-overlapping successive turns advantageously provides a combination of flexibility and support for the antenna 100.

Figure 3:
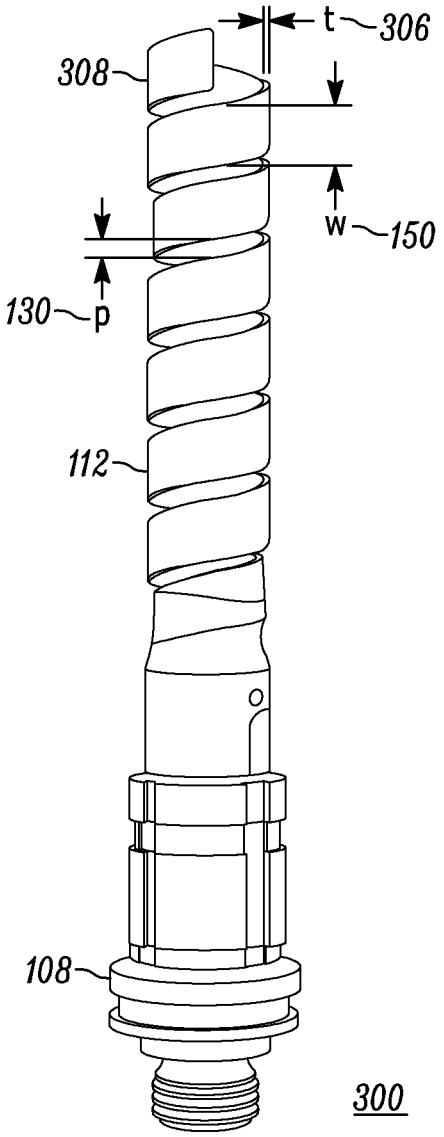
FIG. 3 shows a partially disassembled view of the antenna in accordance with the some embodiments.

FIG. 3 shows a partially disassembled view 300 of antenna 100 in accordance with the some embodiments. View 300 shows first section 102 with attachments means 108 coupled thereto. Attachment means 108 preferably comprises a ferrule connector for mounting and coupling the antenna 100 to an electronic device incorporating transceivers that operate in one or more radio-frequency (RF) bands. While other radio frequency (RF) connector attachment means may be considered, the ferrule connector is easy to construct and cost efficient. Use of a ferrule connector also advantageously provides the ability to use matching components, if desired, at the radio device instead of matching components on the antenna itself thereby negating the use of a pcb at the base of the antenna. Thus, the antenna remains flexible. A plastic housing prevents facilitates alignment for connectivity purposes with an electronic device. Alternatively, the antenna 100 may be mounted and coupled directly to an electronic device.

The rolled conductive strip 112 comprises a substantially uniform width along with a substantially uniform pitch 130 separation between successive turns. The width 150 and pitch 130 can be selected to suit antenna, design parameters. In accordance with some embodiments, the first section comprises a substantially thick "t" 306 conductive strip of material that can be formed into a helical coil, having non-overlapping successive turns. The thickness "t" should be selected to provide sufficient tensile strength to support of the second section 104 of the antenna while maintaining flexibility of the overall antenna structure. For example, the first section 102 may be made of copper sufficiently thick to support the second section while maintaining flexibility. Alternatively, the first section can be made with a core material with high tensile strength that is plated with a surface material with very high electrical conductivity.

Figure 4:
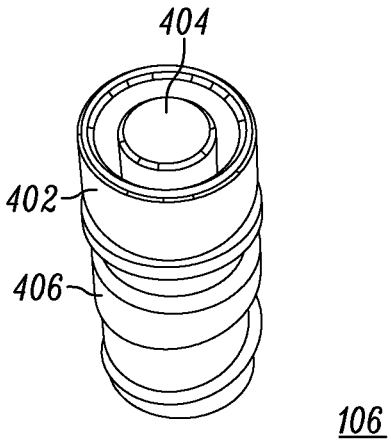
FIG. 4 shows an example of a connector used for interconnecting the first section to the second section of the antenna in accordance with some embodiments.

FIG. 4 shows an example of a connector 106 used for interconnecting the first section to the second section 104 of the antenna 100 in accordance with the some embodiments. Connector 106 has an outer ring 402 and an interior core 404 which electrically short together. In accordance with some embodiments the upper end 308 of rolled conductive strip 112 is soldered, crimped or otherwise coupled, to the exterior of connector 106, and the lower end 602 (shown in FIG. 6) of single wire spring coil 114 is soldered, crimped or otherwise coupled between the interior core 404 and outer ring 402. Connector 106 should be selected to provide sufficient support to the spring coil 114 of the second section 104 as well as sufficient strength to prevent snapping or breaking during flexing of the overall antenna 100. Connector 106 may also be referred to as a mid-section connector.

Figure 5:
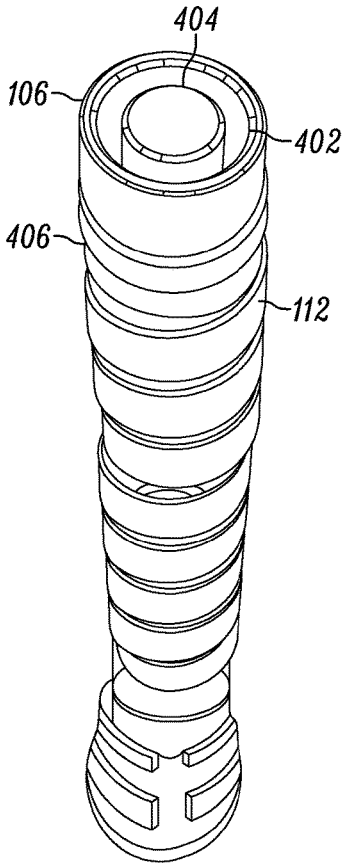
FIG. 5 shows a partially disassembled view of the antenna in accordance with the some embodiments.

FIG. 5 shows a partially disassembled view 500 of antenna 100 in accordance with the some embodiments. In this view, a portion of rolled conductive strip 112 is shown wrapped around an exterior portion 406 of connector 106. Connector 106 comprises ring 402 and interior core 404 for receiving a lower end of the single wire spring coil 114.

Figure 6:
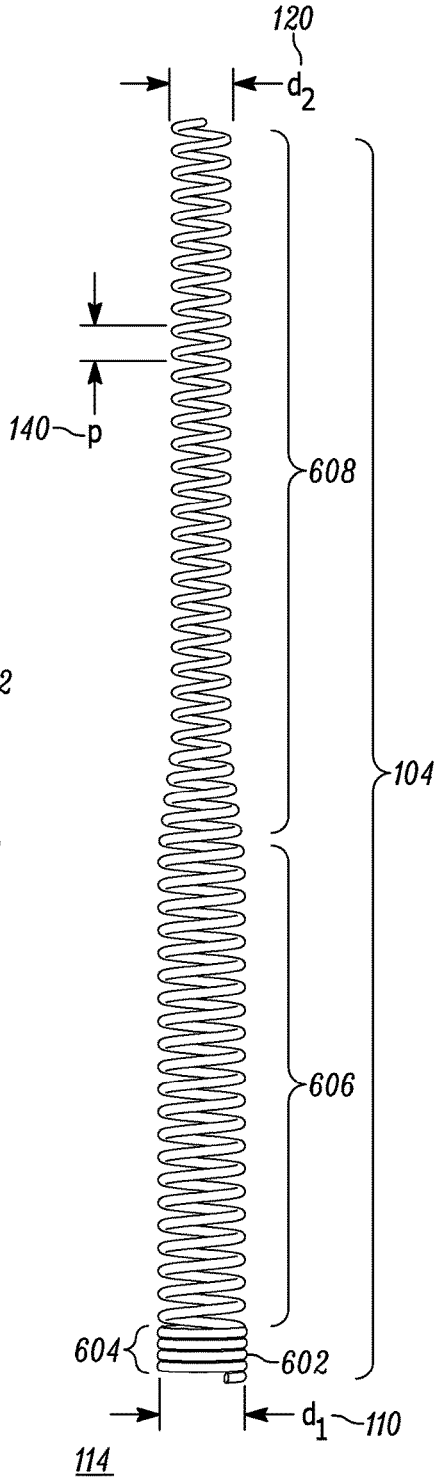
FIG. 6 shows the second section of the antenna in accordance with some embodiments.

FIG. 6 shows the second section 104 of antenna 100 in accordance with some embodiments. The second antenna section 104 comprises a single wire spring coil 114 having a first sub-section 604, a second sub-section 606 and a third sub-section 608. The first sub-section 604 is tightly wound together for a predetermined number of turns which provide sufficient support for the antenna to couple to the interior core 404 and further provides an outer surface 602 which can couple to the outer ring 402 of the mid-section connector 106.

Figure 7:
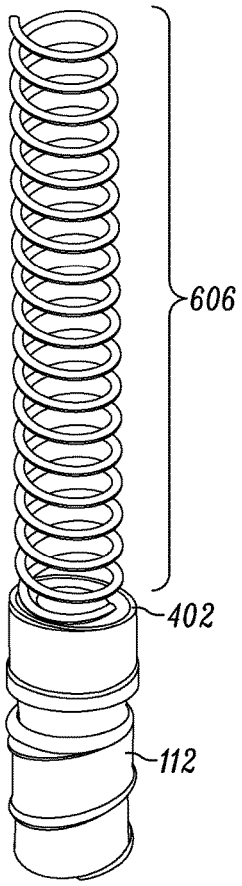
FIG. 7 shows a first sub-section of the single wire spring coil soldered between the interior core and the outer ring of the connector of the antenna in accordance with some embodiments.

In FIG. 7, the first sub-section 602 of the single wire spring coil 114 is soldered between the interior core 404 and the outer ring 402 of connector 106. In this embodiment the next two subsequent sub-sections 606, 608 provide a change in diameter from diameter "d1" 110 to a narrower diameter "d2" 120. The change in diameter for the coiled spring section was only for spacing constraints and did not impact performance. A straight single wire spring coil 114 having a common diameter could also have been used. Excess length of the single wire spring coil 114 can be trimmed as part of the tuning after the antenna is built.

Figure 8:
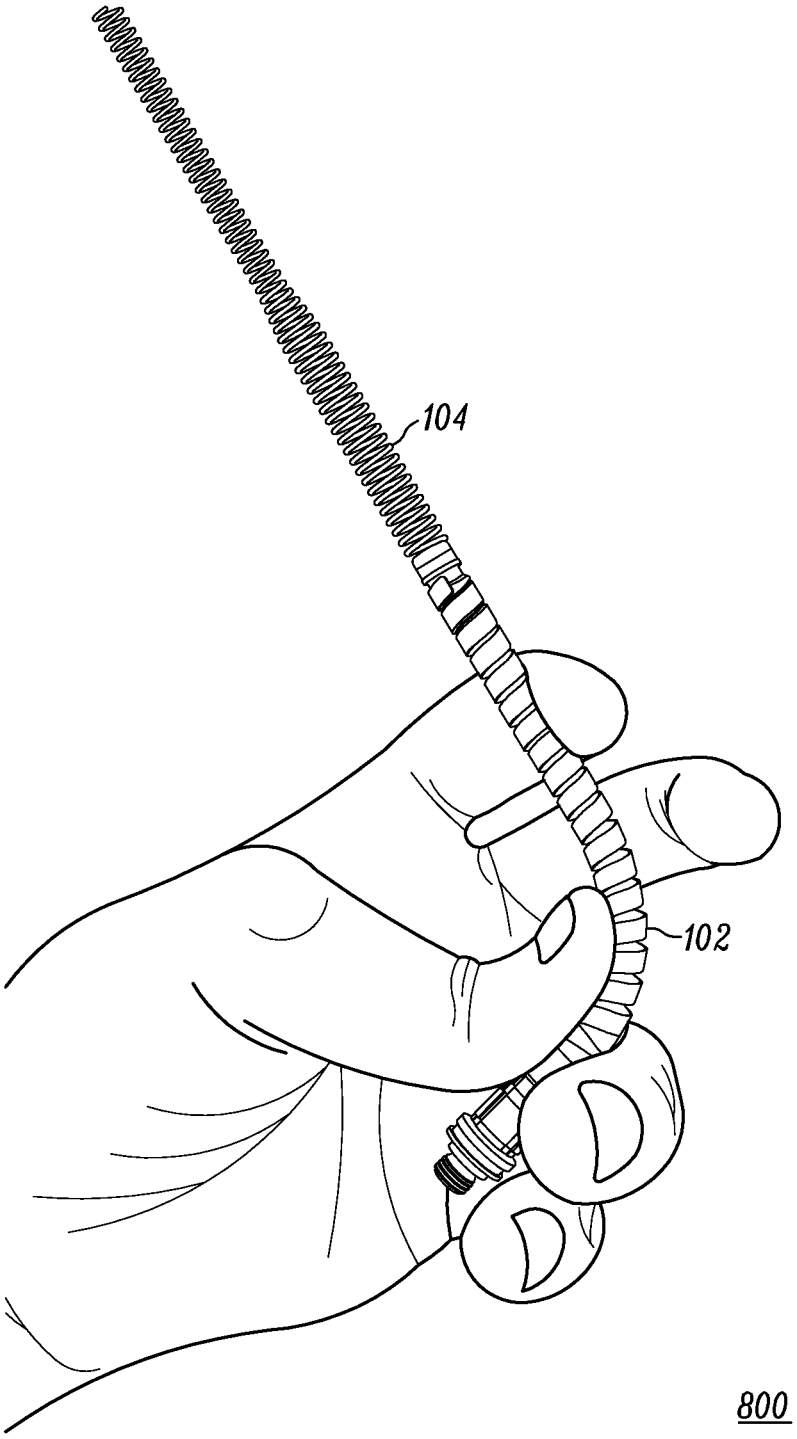
FIGS. 8 and 9 show examples of the antenna being flexed in accordance with some embodiments.
Figure 9:
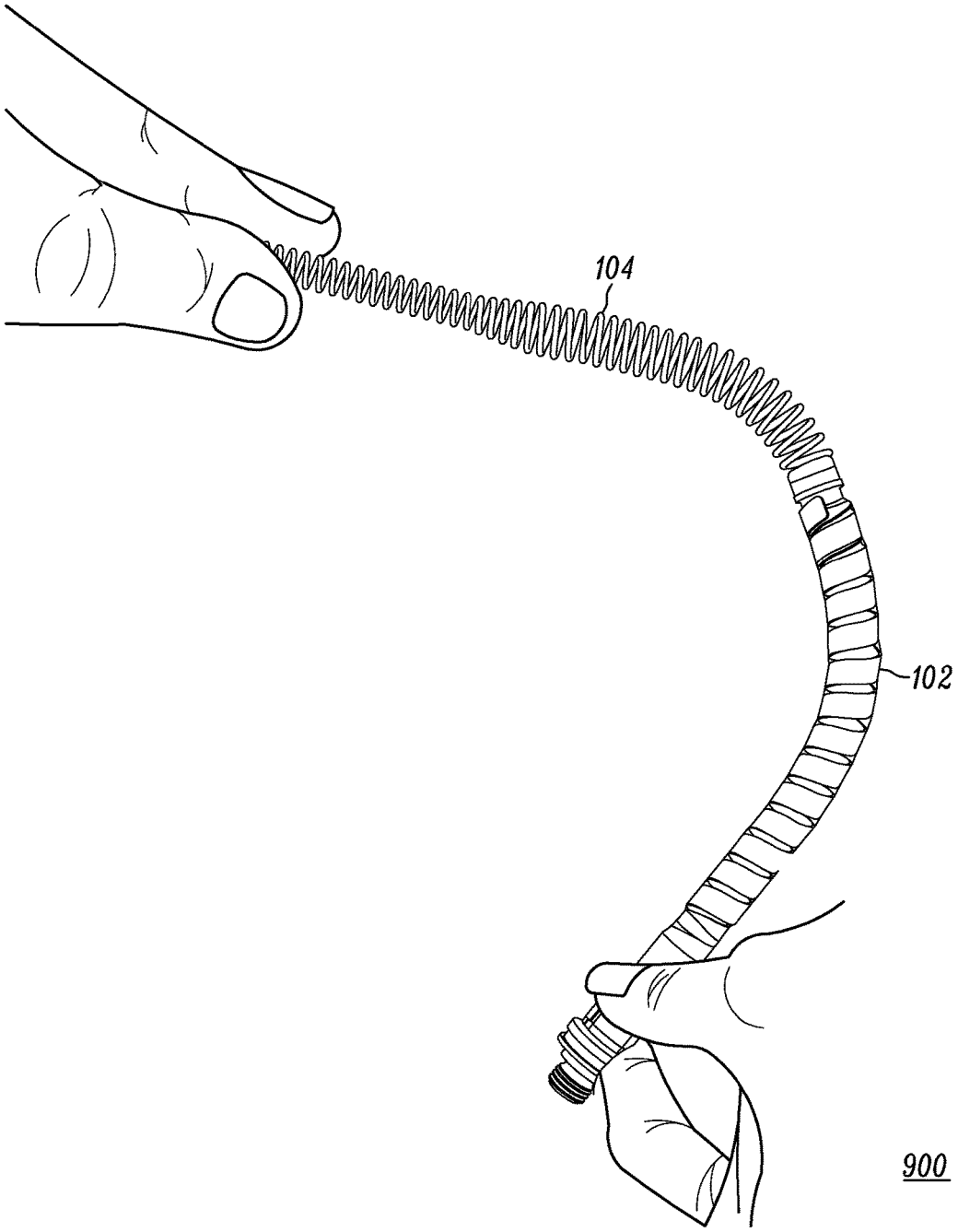

FIGS. 8 and 9 show examples of the antenna 100 being flexed in accordance with some embodiments. View 800 shows the first section 102 being flexed. View 900 shows both the first and section sections 102, 104 being flexed. The antenna 100 returns to its default upright position (FIG. 2) upon release without damage to the structure. The availability of a flexible antenna is highly advantageous to rugged safety environments, for example public safety environment where heavy equipment and susceptibility to drop may be likely.

Figure 10:
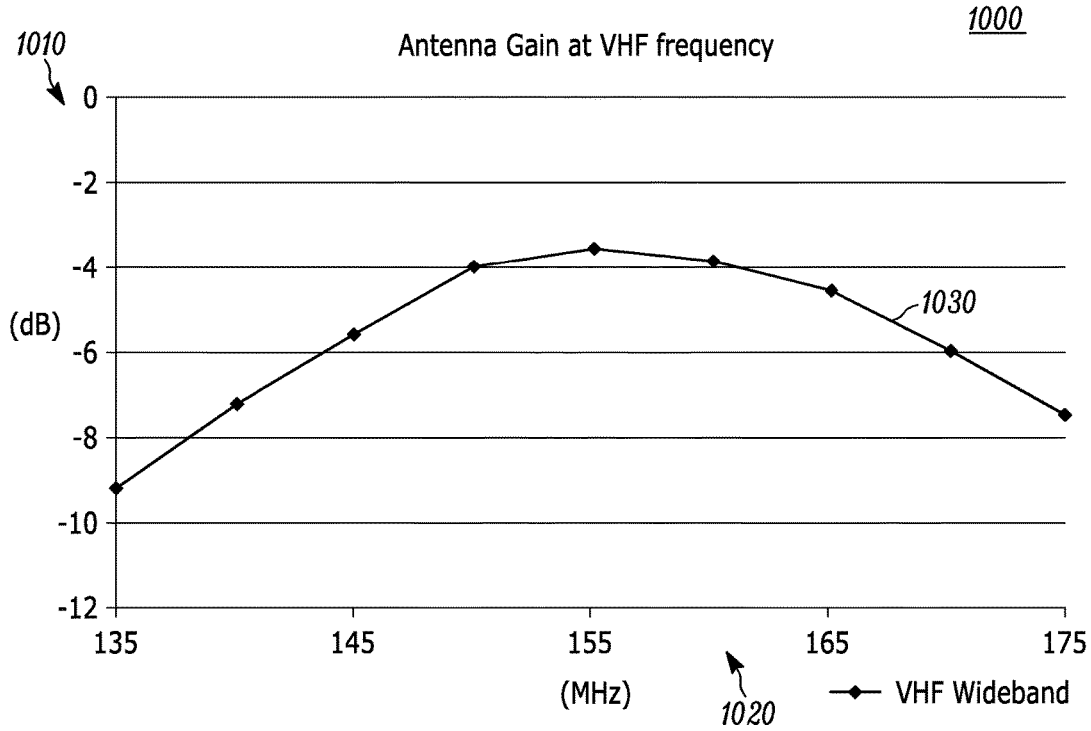
FIGS. 10 and 11 show examples of data taken for an antenna formed and operating in accordance with some embodiments.
Figure 11:
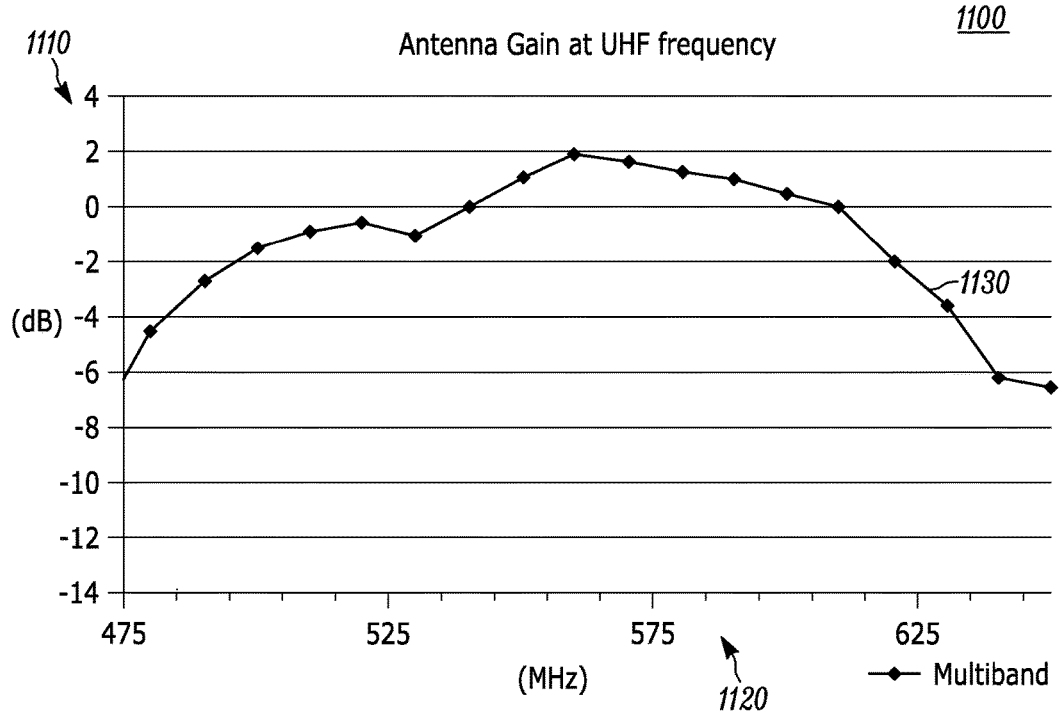

FIGS. 10 and 11 show examples of data taken for the antenna 100 in accordance with some embodiments. Graph 1000 and 1100 show examples of the multiband capability of the antenna 100 operating in both VHF and UHF bands.

FIG. 10 shows graph 1000 demonstrating antenna gain (db) 1010 versus frequency (MHz) 1020 at VHF frequencies. The response 1030 demonstrates a good wideband, response 1030. FIG. 11 shows graph 1100 demonstrating antenna gain (db) 1110 versus frequency (MHz) 1120 at UHF frequencies. The response 1130 demonstrates a good wideband response 1130.

Accordingly, an antenna has been provided that offers a flexible structure with multiband operation capability. The structure with varied width enables wide bandwidth response without matching components. However, bandwidth can be further widened thru proper matching components if desired. The use of a ferrule connector provides the option to utilize matching components on the radio device side instead of matching components on the antenna itself. The antenna structure with varying width offers good performance that work with a single terminal thus lowering the cost of the antenna as well as offering wide multiband response. The use of a single antenna structure eliminates the use of double helixes, transformers, and two terminal approaches thereby providing a simplified approach.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included with in the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action, from another entity or action, without necessarily requiring or implying any actual such relationship or order between such entitles or actions. The terms "comprises," "comprising," "has", "having," "includes", "including," "contains", "containing" or any other variation thereof, are intended to cover a non-exclusive inclusion, such that a process, method, article, or apparatus that, comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment, within 5%, in another embodiment within 1% and in another embodiment within 0.5%. The term "coupled" as used herein is defined as connected, although not necessarily directly and not necessarily mechanically. A device or structure that is "configured" in a certain, way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

We claim:

1. An antenna structure, comprising:

a first section comprising a rolled conductive strip forming a helical coil having non-overlapping successive turns;

a second section coupled to the first section, the second section comprising a wire spring coil having non-overlapping successive turns; and wherein the first and second coupled sections form a single combined antenna structure that function in at least two bands, the at least two bands being independently tunable.

2. The antenna structure of claim 1, wherein:

the first section of the antenna has a first diameter and first length; and the second sections of the antenna has a second diameter and second length.

3. The antenna structure of claim 1, wherein the first section is made of copper sufficiently thick to support the second section while maintaining flexibility.

4. The antenna structure of claim 1, further comprising:

a ferrule connector coupled to the first section.

5. The antenna structure of claim 1, wherein the antenna flexes and recovers to its original shape.

6. The antenna structure of claim 1, wherein the wire spring coil having non-overlapping successive turns is formed of a single wire spring coil having non-overlapping successive turns.

7. The antenna structure of claim 1, wherein first and second sections are mechanically and electrically coupled.

8. An antenna structure, comprising:

a first section comprising a rolled conductive strip forming a helical coil having non-overlapping successive turns;

a second section coupled to the first section, the second section comprising a wire spring coil having non-overlapping successive turns;

a flexible rod about which the first and second sections are wrapped, wherein the flexible rod has a variable diameter which is used to control the diameter of the first and second sections of the antenna.

9. An antenna structure, comprising:

a first section comprising a rolled conductive strip forming a helical coil having non-overlapping successive turns;

a second section coupled to the first section, the second section comprising a wire spring coil having non-overlapping successive turns;

a flexible rod about which the first and second sections are wrapped; and wherein the flexible rod has a variable diameter along its length which varies the diameter of the first and second sections of the antenna along its length.

10. An antenna structure, comprising:

a first section comprising a rolled conductive strip forming a helical coil having non-overlapping successive turns;

a second section coupled to the first section, the second section comprising a wire spring coil having non-overlapping successive turns; and wherein a first diameter and first length of the first section are optimized for resonance at a higher UHF frequency band, and a second diameter and a second length of the second section, in conjunction with the first section, are optimized for resonance at a lower VHF frequency band.

11. An antenna structure, comprising:

a first section comprising a rolled conductive strip forming a helical coil having non-overlapping successive turns;

a second section coupled to the first section, the second section comprising a wire spring coil having non-overlapping successive turns; and wherein a resonance frequency for UHF and VHF bands are tuned independently.

12. An antenna structure, comprising:

a first section comprising a rolled conductive strip forming a helical coil having non-overlapping successive turns;

a second section coupled to the first section, the second section comprising a wire spring coil having non-overlapping successive turns; and the first section allows separate tuning by varying length, pitch or width to control UHF and VHF band frequencies.

13. An antenna structure, comprising:

a first section comprising a rolled conductive strip forming a helical coil having non-overlapping successive turns;

a second section coupled to the first section, the second section comprising a wire spring coil having non-overlapping successive turns; and wherein gain is controlled by length, pitch or width.

14. An antenna structure, comprising:

a first section comprising a rolled conductive strip forming a helical coil having non-overlapping successive turns;

a second section coupled to the first section, the second section comprising a wire spring coil having non-overlapping successive turns; and wherein the antenna is coupled to a radio and provides coverage over: VHF (136-174 MHz) and UHF (380-527 MHz) frequency bands.

15. An antenna structure, comprising:

a first section comprising a rolled conductive strip forming a helical coil having non-overlapping successive turns; and a second section coupled to the first section, the second section comprising a wire spring coil having non-overlapping successive turns; and wherein the antenna provides the following characteristics:

electrical length for first section ($L_1$)) is ~¼λ at UHF; and total electrical length $L_{total}$ for first section and second section is ~¼λ at VHF.

16. An antenna structure, comprising:

a first section comprising a rolled conductive strip forming a helical coil having non-overlapping successive turns;

a second section coupled to the first section, the second section comprising a wire spring coil having non-overlapping successive turns; and wherein the antenna is coupled to a radio without matching components.

17. An antenna structure, comprising:

a first section comprising a rolled conductive strip forming a helical coil having non-overlapping successive turns;

a second section coupled to the first section, the second section comprising a wire spring coil having non-overlapping successive turns; and wherein the antenna is coupled to an electronic device via a ferrule connector and without matching components.

18. An antenna structure, comprising:

a first section comprising a rolled conductive strip forming a helical coil having non-overlapping successive turns;

a second section coupled to the first section, the second section comprising a wire spring coil having non-overlapping successive turns;

wherein the antenna is coupled to an electronic device via a ferrule connector with matching components at the electronic device; and wherein the antenna provides coverage over: VHF (136-174 MHz) and UHF (380-527 MHz) frequency bands.

19. A multi-band antenna, comprising:

a rolled conductive strip forming a helical coil having non-overlapping successive turns; and a wire spring coil having non-overlapping successive turns coupled to the rolled conductive strip; and wherein the multi-band antenna is tunable by varying one or more parameters comprising length, pitch, and width of the non-overlapping successive turns of the rolled conductive strip and the non-overlapping successive turns of the wire spring coil.

20. The multi-band antenna of claim 19, further comprising:

a ferrule connector coupled to the rolled conductive strip.

* * * * *